United States Patent [19]

Tanczyn

[11] 4,179,285

[45] Dec. 18, 1979

[54] FERRITIC STAINLESS STEEL

[75] Inventor: Harry Tanczyn, Baltimore, Md.

[73] Assignee: Armco Inc., Middletown, Ohio

[21] Appl. No.: 928,595

[22] Filed: Jul. 27, 1978

[51] Int. Cl.[2] ..... C22C 38/24; C22C 38/26

[52] U.S. Cl. ..... 75/126 E; 75/126 F; 75/126 J; 148/37

[58] Field of Search ..... 75/126 E, 126 F, 126 J; 148/37

[56] References Cited

U.S. PATENT DOCUMENTS

| | | | |
|---|---|---|---|
| 1,954,344 | 4/1934 | Becket et al. | 75/126 F |
| 2,624,669 | 1/1953 | Crafts | 75/126 J |
| 2,965,479 | 12/1960 | Evans, Jr. | 75/126 F |
| 3,963,532 | 6/1976 | Demo, Jr. | 75/126 J |
| 4,010,049 | 3/1977 | Rarey | 75/126 F |

FOREIGN PATENT DOCUMENTS

| | | | |
|---|---|---|---|
| 884806 | 11/1971 | Canada | 75/126 F |
| 50-4166 | 2/1975 | Japan | 75/126 F |
| 528729 | 5/1940 | United Kingdom | 75/126 F |

*Primary Examiner*—Arthur J. Steiner

*Attorney, Agent, or Firm*—Melville, Strasser, Foster & Hoffman now Frost & Jacobs

[57] ABSTRACT

A substantially fully ferritic stainless steel having improved hot rolling and cold drawing properties, consisting essentially of from 0.010% to 0.17% carbon, 0.05% to 1.0% manganese, 0.05% to 1.0% silicon, 20.0% to 30.0% chromium, 0.05% to 0.35% nitrogen, 0.15% to 1.0% columbium, up to 0.50% vanadium, up to 0.75% molybdenum, 0.040% maximum phosphorus, 0.030% maximum sulfur, and remainder essentially iron. Columbium carbo-nitrides are distributed as dispersoids in a ferritic matrix and provide a strenghtening effect which prevents scratches, seams and longitudinal folds in hot rolled material and galling and scratches in cold drawn material. Preferably columbium plus vanadium is not more than 4 times carbon plus nitrogen.

2 Claims, No Drawings

FERRITIC STAINLESS STEEL

BRIEF SUMMARY OF THE INVENTION

This invention relates to a high chromium, substantially fully ferritic stainless steel having improved hot workability and cold drawability. Although not so limited, the steel has particular utility in applications where bondability to glasses is required. Other applications include magnetic cores for solenoids, welding wire for the joining of steels of low coefficient of thermal expansion, electrodes for electrically-heated salt baths, and applications requiring corrosion resistance and resistance against scaling at high temperatures.

The requirements for bondability to glasses are that the steel have a coefficient of thermal expansion close to that of the glass and that a gas-tight adhesive bond be formed between the steel and the glass.

A.I.S.I. Types 442 and 446 ferritic stainless steels are straight chromium grades which have been manufactured for many years, principally for the fabrication of parts which must resist scaling at high temperatures. The nominal composition of Type 442 is 0.20% maximum carbon, 1.00% maximum manganese, 0.040% maximum phosphorus, 0.030% maximum sulfur, 1.00% maximum silicon, 18.00% to 23.00% chromium, and remainder essentially iron. The nominal composition of Type 446 is 0.20% maximum carbon, 1.50% maximum manganese, 0.040% maximum phosphorus, 0.030% maximum sulfur, 1.00% maximum silicon, 23.00% to 27.00% chromium, 0.25% maximum nitrogen, and balance essentially iron.

An article by Becket and Franks in *AIMMEE Transactions*, volume 113, pages 126–137 (1934), and U.S. Pat. No. 1,954,344 to Becket and Franks discuss the addition of columbium and/or titanium to high chromium steels. These disclosures conclude that steels containing more than 16% chromium "cannot be appreciably hardened". On the other hand, steels containing 5% to 12% chromium (and no titanium or columbium) are quite hard and have very little ductility. It was found that columbium additions to all the steels of at least about 4 times the carbon content and not more than 8 times the carbon content resulted in ductile and soft steels.

U.S. Pat. No. 2,745,738, issued to Phillips et al, discloses a steel containing 0.005% to 0.12% carbon, 15% to 20% chromium, up to 1.00% manganese, up to 1.00% silicon, up to 1.00% aluminum, up to 1.00% titanium, up to 1.00% nickel, 0.04% maximum phosphorus, 0.03% maximum sulfur, and balance substantially iron. A formula is given for balancing austenite and ferrite formers to provide a fully ferritic steel, and a formula is provided for balancing silicon, aluminum and manganese with nickel, chromium and titanium in order to obtain a desired coefficient of thermal expansion. In the preferred embodiment a titanium content of 0.40% to 1.00% is used to assure a fully ferritic structure and a coefficient of thermal expansion less than $11.7\times10^{-6}$ inch per inch per degree C. at temperatures between 30° and 530° C.

U.S. Pat. No. 2,220,690 discloses a steel alleged to have good bondability to glass comprising 0.25% maximum carbon, 1% manganese, 0.025% maximum phosphorus, 0.5% silicon, 23% to 30% chromium, and remainder substantially iron.

U.S. Pat. No. 2,965,479 discloses the addition of small amounts of columbium to high chromium ferritic steels.

U.S. Pat. No. Re. 26,225 discloses the addition of vanadium to high chromium steels.

Although A.I.S.I. Type 446 steel has been manufactured commercially for many years, production has always been difficult. More specifically, in hot working ingots and billet stock, the steel tends to take the forms of the cavities in the work-roll areas by dishing out in all directions rather than projecting itself at right angles to the work-roll positions. Moreover, the steel galls and is severely scratched by moving contacts with mill processing equipment and is subject to deep seams and longitudinal folds during mill processing. Cold drawing into wire also has been difficult due to the susceptibility of the steel to galling and scratching.

It is thus apparent that Type 446 stainless steel has good corrosion and heat scale erosion resistance, good weldability and good bondability to glasses, but that processing difficulties are of such magnitude as to discourage commercial production. The prior art disclosures regarding alloying additions of columbium, titanium and/or vanadium neither suggest nor inherently provide any solution to the processing difficulties.

It is therefore evident that a genuine need exists for a modified high chromium ferritic stainless steel having good hot workability and good cold drawability while maintaining the desirable properties which give such a steel great utility in a variety of applications.

It is a principal object of the present invention to provide a substantially fully ferritic high chromium stainless steel modified by alloying additions which produce dispersion strengthening therein, thereby achieving good hot workability and good cold drawability.

It is a further object of the invention to provide a substantially fully ferritic stainless steel having the above properties, which contains a minimum of expensive alloying elements other than chromium, and which can be produced by relatively economical processing steps.

DETAILED DESCRIPTION

It has been discovered that greatly improved mill processing characteristics can be achieved in a substantially fully ferritic high chromium stainless steel containing iron-columbium-intermetallic compounds and columbium carbonitride compounds for dispersion strengthening effects.

In broad composition ranges, the steel of the present invention consists essentially of, in weight percent, from about 0.010% to 0.17% carbon, about 0.05% to about 1.0% manganese, about 0.05% to about 1.0% silicon, about 20.0% to about 30.0% chromium, 0.05% to about 0.35% nitrogen, 0.15% to about 1.0% columbium, up to 0.50% vanadium, up to 0.75% molybdenum, 0.040% maximum phosphorus, 0.030% maximum sulfur, and remainder essentially iron.

The elements carbon, chromium, nitrogen, columbium and iron are essential in every respect. The maximum carbon content, minimum nitrogen and minimum columbium contents are critical in achieving optimum hot and cold working properties. Moreover, the combined columbium and vanadium contents must be sufficient to lower the amounts of carbon and nitrogen in solution in the iron below that which would cause occurrence of an austenite phase or a dual austenitic-ferritic structure. In this connection, it will be understood that the presence of austenite has a detrimental effect on bondability of the steel to glass because austenite has a greater coefficient of thermal expansion. Additionally, a dual austenitic-ferritic structure would impair hot workability due to differentials in mechanical strength.

At the same time, it should be recognized that the presence of appreciable amounts of carbon and nitrogen in the steel make the processing more economical since elimination thereof involves expensive additional steps such as vacuum degassing. Thus, although low nitrogen is preferred for applications requiring good bondability between the steel and glasses, it is more economical from the processing standpoint to permit substantial nitrogen levels to remain. Of still greater significance, it has been found that columbium carbo-nitride dispersons are more effective in improving the hot and cold working properties than vanadium carbide dispersions, as will be shown hereinafter.

For convenience columbium will be referred to throughout as though it were a pure element. However, tantalum and columbium occur together naturally in ore, and no separation is ordinarily made in the refining of columbium ores. Accordingly, the term columbium as used herein is to be considered as including such amounts of tantalum as occur naturally in normally refined columbium. Tantalum is believed to function in the same manner as columbium in the steel of the present invention.

Vanadium is not an essential element in the steel of the present invention but is always present as an impurity in iron-chromium alloys, so that a purposeful vanadium addition is not necessary. On the other hand, since vanadium is a strong carbide former (but a weak nitride former) a purposeful vanadium addition may be beneficial for carbon contents near the upper end of the carbon range.

Although not wishing to be bound by theory, it appears that columbium reacts with carbon and nitrogen, and vanadium reacts with carbon to form columbium carbo-nitrides and vanadium carbides respectively, which are insoluble and are deposited uniformly throughout the ferritic matrix of the steel in the form of relatively small dispersoids. Iron-columbium intermetallic compounds are apparently also formed which are insoluble and are distributed as dispersoids. These dispersoids strengthen the ferritic matrix, in direct proportion to the total volume thereof, and decrease susceptibility to galling and scratching.

An optimum combination of properties is obtained in a preferred composition consisting essentially of, in weight percent, from about 0.05% to about 0.15% carbon, about 0.1% to about 0.7% manganese, about 0.2% to about 0.75% silicon, about 23% to about 28% chromium, about 0.1% to about 0.25% nitrogen, about 0.25% to about 0.6% columbium, about 0.02% to about 0.2% vanadium, about 0.2% maximum molybdenum, about 0.04% maximum phosphorus, about 0.03% maximum sulfur, and remainder essentially iron, with columbium plus vanadium being not more than about 4 times carbon plus nitrogen.

A.I.S.I. Type 446 stainless steel differs from Type 442 in a purposeful nitrogen addition for the purpose of strengthening the cast structure. However, it will be recognized that the addition of still further carbon and nitrogen to Type 446 would produce a duplex structure of austenite and ferrite. As indicated above such a structure has poor hot workability because of the differential mechanical strengths of austenite and ferrite, which imposes mechanical stress thereon when hot worked. Since the austenite fraction exhibits a greater coefficient of thermal expansion and contraction than the ferrite phase, bondability to glass of such a duplex structure is poor. The present invention overcomes these problems by incorporation of columbium in a Type 446 steel modified by addition of carbon and nitrogen in amounts which would otherwise produce a duplex structure. The columbium addition produces a dispersoid which is insoluble at hot working temperatures and at temperatures at which the steel would be bonded to glass, thereby controlling the metal deformation pattern during hot working and bonding to glass. Reduction of the soluble carbon and nitrogen contents in the steel by addition of columbium establishes and maintains a substantially fully ferritic phase. Where carbon and nitrogen are near the lower limits of the preferred ranges set forth above the columbium addition reacts predominantly with iron and/or chromium to form insoluble dispersoids which provide the desired strengthening and hardening function, without impairing good bonding characteristics with glass.

Of the various elements ordinarily considered useful for reaction with carbon, nitrogen and iron to form dispersions, it has been found that columbium is most efficient in reactivity for all three reactions. Tantalum is substantially equivalent to columbium in this respect but is much more expensive. Vanadium, molybdenum and tungsten are strong carbide formers but are weak in reactivity with nitrogen and iron. Titanium and zirconium are strong nitride formers, but fix nitrogen as insoluble nitrides in molten iron-base alloys and produce clusters of nitrides which, with mechanical working, damage surface condition and impair cold drawing operations.

In raw materials ordinarily available for charging into melting furnaces for production of stainless steels, the initial carbon content may range as high as 2%. This is lowered during the conventional refining process to the broad range of 0.010% to 0.17% carbon without the necessity of additional expensive processing steps such as vacuum degassing. The minimum carbon content of the present steel thus insures high manufacturing efficiency and low production costs while at the same time providing columbium carbide as an insoluble dispersoid having a beneficial effect on the physical properties of the steel. The maximum carbon content of 0.17% is critical in achieving good hot working and cold drawing properties, as will be shown hereinafter.

Nitrogen is used in refining the initial furnace charge for the steel since, in combination with oxygen, nitrogen removes carbon from the melt. This results inevitably in some absorption of nitrogen by the molten steel, which has been found to be beneficial because of its subsequent reaction with columbium. Hence it is unnecessary to restrict nitrogen to a low level, and in fact a minimum of 0.05% is critical in obtaining optimum hot working and cold drawing properties, as shown hereinafter. On the other hand, excessive nitrogen exceeding the solubility limit in the solidified steel produces internal unsoundness in castings such as ingots. In addition, nitrogen is of course a strong austenite former. For these reasons, a maximum of about 0.35% nitrogen must be observed.

Chromium is essential, with a minimum of about 20% being necessary for corrosion resistance. A maximum of about 30% chromium must be observed in order to avoid hot working difficulties. Within this range it has been found that chromium produces iron-chromium alloys having coefficients of thermal expansion and contraction which are compatible with selected glasses.

Variation in the chromium content also permits the selection of a desired coefficient of thermal expansion and contraction.

The elements manganese, silicon, phosphorus and sulfur are not essential in the steel of the invention but are normally occurring impurities.

Manganese in amounts not exceeding about 1% is not detrimental, but amounts in excess of this value would tend to stabilize any transient austenite in a cast product, thus causing a duplex austenite-ferrite structure to persist after hot working.

Silicon is normally added during refining in order to return to the molten metal the chromium which is oxidized during the carbon-removal period. A maximum of about 1% silicon has been found to be sufficient to assure chromium recovery. Silicon additions greater than about 1.5% produce chromium-silicide compounds which remove chromium from the ferritic matrix. This in turn would increase the coefficient of thermal expansion of the steel with consequent detriment to glass bonding properties. Since the ratio of chromium atoms to silicon atoms in the chromium-silicide compound is 3:1, it is evident that an excess of silicon should be avoided.

Phosphorus should be maintained at a maximum of about 0.040% since greater amounts embrittle the ferritic structure and lower the heat scale resistance of the steel. If improved machinability is desired, sulfur could be increased to a maximum of 0.10%. However, sulfur in excess of 0.10% would react with chromium to form a chromium sulfide which migrates into the overlying slag in the molten metal, thus depleting the chromium content.

A series of Heats has been prepared and tested for hot working and cold drawing properties. For purposes of comparison, a number of additional Heats have one or more elements outside the ranges of the steel of the present invention were also prepared and tested.

The various Heats were rated from the standpoint of hot rollability, freedom from surface galling and scratching, and cold drawability into wire. The various Heats were rated on a numerical scale for both hot working and cold drawing properties, with 1 being excellent, 2 good, 3 fair and 4 poor. A rating of 1 or 2 for both hot working and cold drawing also indicates freedom from surface galling and scratches, and absence of deep seams and longitudinal folds. The compositions of the Heats and their ratings are set forth in Table I.

TABLE I

| Heats | C | Mn | P | S | Si | Cr | N | Cb | V | Mo | Ti | RATINGS Hot Working | RATINGS Cold Drawing |
|---|---|---|---|---|---|---|---|---|---|---|---|---|---|
| 1 | .26 | .20 | .017 | .011 | .55 | 24.46 | .036 | .01 | .14 | .01 | | 2 | 4 |
| 2 | .22 | .18 | .018 | .014 | .46 | 24.36 | .049 | .14 | .14 | .02 | | 2 | 4 |
| 3 | .19 | .16 | .013 | .023 | .53 | 23.53 | .052 | .10 | .35 | .02 | | 2 | 4 |
| 4 | .19 | .12 | .012 | .018 | .56 | 24.38 | .050 | .14 | .29 | .02 | | 2 | 4 |
| 5 | .21 | .12 | .011 | .012 | .73 | 24.17 | .054 | .01 | .12 | .01 | .14 | 3 | 4 |
| 6 | .18 | .13 | .016 | .012 | .67 | 24.17 | .14 | .01 | .26 | .01 | .02 | 3 | 3 |
| 7 | .18 | .14 | .009 | .013 | .60 | 23.13 | .20 | .01 | .20 | .01 | .01 | 3 | 3 |
| 8* | .14 | .18 | .012 | .015 | .53 | 24.13 | .056 | .16 | .15 | .01 | — | 2 | 2 |
| 9* | .093 | .35 | .011 | .011 | .71 | 24.11 | .17 | .42 | .05 | .01 | — | 1 | 1 |
| 10* | .096 | .26 | .009 | .013 | .62 | 24.24 | .20 | .44 | .04 | .01 | — | 1 | 1 |
| 11* | .092 | .24 | .006 | .013 | .59 | 24.55 | .19 | .46 | .02 | .01 | — | 1 | 1 |
| 12* | .092 | .28 | .008 | .013 | .62 | 24.53 | .18 | .47 | .02 | .01 | — | 1 | 1 |
| 13* | .096 | .39 | .020 | .014 | .59 | 23.93 | .16 | .39 | .06 | .06 | — | 1 | 1 |

*Steels of the invention.

From the standpoint of hot and cold working properties a rating of 1 and 2 for both hot working and cold drawing is considered acceptable, while anything inferior thereto is considered unacceptable for commercial production.

It will be apparent that all the steels of the invention, Heats 8 through 13 of Table I, exhibited good or excellent ratings both for hot working and cold drawing, whereas none of Heats 1–7 exhibited acceptable ratings for cold drawing.

From an inspection of the data of Table I it is immediately apparent that Heats 5, 6 and 7, each containing 0.01% columbium and varying levels of vanadium and titanium, exhibited fair to poor hot working and cold drawing properties. This confirms the conclusion set forth above regarding the unsuitability of the combination of titanium nitrides or carbo-nitrides and vanadium carbides as dispersoids.

A comparison of Heats 2 and 4 with Heat 8 shows the criticality of the maximum carbon content of 0.17%, the minimum nitrogen content of 0.05% and the minimum columbium content of 0.15%. The carbon contents of Heats 2 and 4 are slightly above the maximum, the nitrogen contents are substantially at the minimum and the columbium contents are just below the minimum. On the other hand, Heat 8 has carbon, nitrogen and columbium contents within the limits of the steel of the invention, and the steel exhibited good hot working and cold drawing properties, whereas Heats 2 and 4 exhibited poor cold drawing properties despite good hot working properties.

The maximum carbon content, minimum nitrogen content, and minimum columbium content of the steel of the invention have been established from the composition and properties of Heat 8 with due regard to standard analytical tolerances for these three elements. More specifically, the tolerance for carbon within the percentage range of 0.10% to 0.29% is ±0.01%, so that the carbon content of 0.14% of Heat 8 could be as high as 0.15%. The tolerance for nitrogen (acid and alkali soluble) within the range of 0.040% to 0.069% is ±0.004%, so that the nitrogen content of 0.056% of Heat 8 could be 0.052%. The tolerance for columbium within the range of 0.10% to 0.29% is ±0.01%, so that the columbium content of 0.16% of Heat 8 could be 0.15%.

A comparison of Heats 4 and 8 with the standard analytical tolerances applied indicates that there is an absolute difference in carbon contents (a minimum of 0.18% in Heat 4 and a maximum of 0.15% in Heat 8) even though there could be a very slight overlap of the nitrogen content and a touching (but not overlapping)

of the columbium contents. The criticality of the carbon content and the relative proportioning among the elements carbon, nitrogen and columbium, is thus clearly shown.

Heat 1 is illustrative of the results obtained with dispersants consisting principally of vanadium carbides, of columbium and nitrogen contents of Heat 1 being too low to cause significant formation of columbium carbonitrides. It was found that in cold drawing the steel of Heat 1 developed micro-separations at junctions of the ferrite matrix and carbide clusters. Inadequate bend ductility in a reverse bend test was also noted for the steel of this Heat.

This is to be contrasted with Heats 9–13, all of which had carbon contents below 0.1%, vanadium contents not greater than 0.06% and columbium contents ranging from 0.39% to 0.47% along with purposeful nitrogen additions ranging from 0.16% to 0.20%. In these Heats the dispersants consisted primarily of columbium carbo-nitrides and perhaps iron-columbium intermetallic compounds. All these Heats exhibited excellent hot working and cold drawing properties.

It is evident from Heats 9–13 that no stoichiometric balancing of columbium with carbon and nitrogen is necessary in the steel of the present invention. On the other hand, Heats 1–7 illustrate that excessive carbon is detrimental, and for best results the carbon to nitrogen weight ratio should not exceed 1:1.

In a steel within the preferred composition ranges of the invention having, e.g., about 0.1% carbon, about 0.2% nitrogen, about 0.45% columbium, about 0.04% vanadium, and about 24% chromium, the amount of carbon plus nitrogen not combined with columbium and vanadium should not exceed 0.25%, to assure freedom from austenite. Conversely, the columbium plus vanadium contents perferably will be no more than about 4 times the carbon plus nitrogen contents.

Variations in the chromium content, or in the contents of other ferrite formers, can be made in order to control the amounts of carbon plus nitrogen which may be present in uncombined form, thus ensuring a substantially fully ferritic matrix.

The volume fraction of small, uniformly distributed dispersoid must be sufficient to produce internal strengthening, and this is assured by the minimum carbon, nitrogen and columbium contents of the steel of the invention. At the other extreme, an excessive volume fraction of dispersoid adversely affects the cold-workability of semi-finished mill products and the bend ductility of final products such as terminal pins. The maximum carbon, nitrogen and columbium contents of the steel of the invention have been found to avoid these undesirable effects.

Within the broad and preferred ranges of carbon, nitrogen and columbium, an approximate volume fraction of columbium carbo-nitride dispersoids can be selected which is best suited for intended end uses and products. Thus, for heating electrodes for salt baths a maximum volume fraction of dispersoid is desirable for high strength. For cold-drawn terminal wire and welding wire a minimum volume fraction is desirable in order to facilitate cold-drawing operations and maximize bend ductility.

More specifically, heating electrodes for salt baths according to the invention consist essentially of, in weight percent, from about 0.10% to 0.17% carbon, about 0.05% to about 1.0% manganese, about 0.05% to about 1.0% silicon, about 20.0% to about 30.0% chromium, about 0.20% to about 0.35% nitrogen, about 0.50% to about 1.0% columbium up to 0.50% vanadium, up to 0.75% molybdenum, 0.040% maximum phosphorus, 0.030% maximum sulfur, and remainder essentially iron.

Cold-drawn terminal wire and welding wire in accordance with the invention consist essentially of, in weight percent, from about 0.010% to about 0.06% carbon, about 0.05% to about 1.0% manganese, about 0.05% to about 1.0% silicon, about 20.0% to about 30.0% chromium, 0.05% to about 0.10% nitrogen, 0.15% to about 0.30% columbium, up to 0.20% vanadium, up to 0.75% molybdenum, 0.040% maximum phosphorus, 0.030% maximum sulfur, and remainder essentially iron.

The steel of the invention may be melted in any conventional manner, and, as indicated above, decarburizing and denitriding are not necessary. The steel may be cast into ingots and worked into billets and slabs, or may be continuously cast in slab form. The steel exhibits good to excellent hot workability in conventional hot rolling equipment and is virtually free from surface galling and scratching. When hot worked into rod or bar stock the steel may be cold drawn into wire without problems.

Preferred steels in accordance with this invention have been tested for bonding to glass, and the coefficient of thermal expansion and bond strength have been found to be admirably suited for this purpose. Moreover, the broad chromium range of 20% to 30% permits the selection of variations in thermal expansion and contraction characteristics which may be needed for bonding to a variety of commercial glass compositions.

It is thus evident that the present steel exhibits hot workability, cold workability, anti-galling and anti-scratching properties, and good bondability to glasses. This novel combination of properties has not been found in any prior art alloy.

The embodiments of the invention in which an exclusive property or privilege is claimed are defined as follows:

1. A substantially fully ferritic stainless steel consisting essentially of, in weight percent, from about 0.05% to about 0.15% carbon, about 0.1% to about 0.7% manganese, about 0.2% to about 0.75% silicon, about 23% to about 28% chromium, about 0.1% to about 0.25% nitrogen, about 0.25% to about 0.6% columbium, about 0.02% to about 0.2% vanadium, about 0.2% maximum molybdenum, about 0.04% maximum phosphorus, about 0.03% maximum sulfur, and remainder essentially iron, with the columbium plus vanadium contents being not more than about 4 times the carbon plus nitrogen contents.

2. The steel claimed in claim 1, wherein said columbium is in the form of columbium carbo-nitrides and iron-columbium intermetallic compounds distributed as dispersoids in a ferritic matrix.

* * * * *